US009247362B2

(12) United States Patent
Elkington

(10) Patent No.: US 9,247,362 B2
(45) Date of Patent: Jan. 26, 2016

(54) HANDS-FREE CELLULAR TELEPHONE ENABLED SPA

(75) Inventor: Donald Alfred Elkington, Surrey (CA)

(73) Assignee: Coast Spas Manufacturing Inc., Langley (CA)

( * ) Notice: Subject to any disclaimer, the term of this patent is extended or adjusted under 35 U.S.C. 154(b) by 798 days.

(21) Appl. No.: 13/347,382

(22) Filed: Jan. 10, 2012

(65) Prior Publication Data

US 2013/0007955 A1 Jan. 10, 2013

Related U.S. Application Data

(60) Provisional application No. 61/431,834, filed on Jan. 11, 2011.

(51) Int. Cl.

| | |
|---|---|
| ***A47K 3/02*** | (2006.01) |
| ***H04R 27/00*** | (2006.01) |
| *E04H 4/14* | (2006.01) |

(52) U.S. Cl.
CPC *H04R 27/00* (2013.01); *E04H 4/14* (2013.01); *H04R 2201/107* (2013.01); *H04R 2420/07* (2013.01)

(58) Field of Classification Search
CPC ..... H04R 27/00
USPC ..... 4/541.1, 546, 559, 584; 381/333, 387; 455/404.1
See application file for complete search history.

(56) References Cited

U.S. PATENT DOCUMENTS

| | | | |
|---|---|---|---|
| 2004/0047484 A1 | 3/2004 | Gardenier et al. | |
| 2004/0068787 A1 | 4/2004 | Lauter et al. | |
| 2008/0098509 A1 | 5/2008 | Kantor et al. | |
| 2010/0046785 A1 | 2/2010 | Schmidt et al. | |
| 2011/0059719 A1* | 3/2011 | Spielvogel et al. | 455/404.1 |

* cited by examiner

*Primary Examiner* — Tuan N Nguyen
(74) *Attorney, Agent, or Firm* — Bruce M. Green; Oyen Wiggs Green & Mutala LLP

(57) ABSTRACT

A spa enabled to permit a user to conduct hands-free mobile telephone calls while immersed in the spa, comprising a Bluetooth enabled audio system contained in one or more watertight compartments, including a microphone and one or more speakers, whereby the Bluetooth enabled audio system is adapted to be paired with and wirelessly communicate with a Bluetooth enabled mobile phone to permit hands-free use in the spa.

8 Claims, 3 Drawing Sheets

HANDS-FREE CELLULAR TELEPHONE ENABLED SPA

CROSS REFERENCE TO RELATED APPLICATION

The present application claims the benefits, under 35 U.S.C. §119(e), of U.S. Provisional Application Ser. No. 61/431,834 filed Jan. 11, 2011 entitled "Hands-Free Cellular Telephone Enabled Spa" which is incorporated herein by this reference.

TECHNICAL FIELD

The application relates to the field of hot tubs and spas.

BACKGROUND

Hot tubs or spas (collectively "spas") are widely installed in residences, hotels, fitness facilities and the like for relaxation, entertainment and therapeutic reasons. It is not uncommon currently for such spas to include built-in audio and speaker systems so that occupants of the spa can listen to music or television. See for example published U.S. patent applications 2004/0047484, 2004/0068787 and 2010/0046785. However, in the past if a person wished to make a cellular telephone call while immersed in the spa there was a risk of damaging the telephone due to moisture. There is therefore a need for a spa design which permits a person to make a hands-free cellular telephone call while immersed in the spa.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

The present invention provides a spa enabled to permit a user to conduct hands-free mobile telephone calls while immersed in the spa, comprising a Bluetooth enabled audio system contained in one or more watertight compartments, including a microphone and one or more speakers, whereby the Bluetooth enabled audio system is adapted to be paired with and wirelessly communicate with a Bluetooth enabled mobile phone to permit hands-free use in the spa.

The present invention further provides a microphone enclosure specifically adapted for hands-free use of a mobile phone in a spa. The microphone enclosure comprises a hollow enclosure sized to extend through an aperture in a supporting wall of the spa for receiving a microphone and having a sealable flange secured around the circumference of a first end of the hollow enclosure for sealingly securing the hollow enclosure to the wall, with a passage extending through the first end sealingly covered by a sound-transmitting element, such as a plastic disc mounted on a rubber O-ring.

In addition to the exemplary aspects and embodiments described above, further aspects and embodiments will become apparent by reference to the drawings and by study of the following detailed descriptions.

BRIEF DESCRIPTION OF DRAWINGS

Exemplary embodiments are illustrated in referenced figures of the drawings. It is intended that the embodiments and figures disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 1:
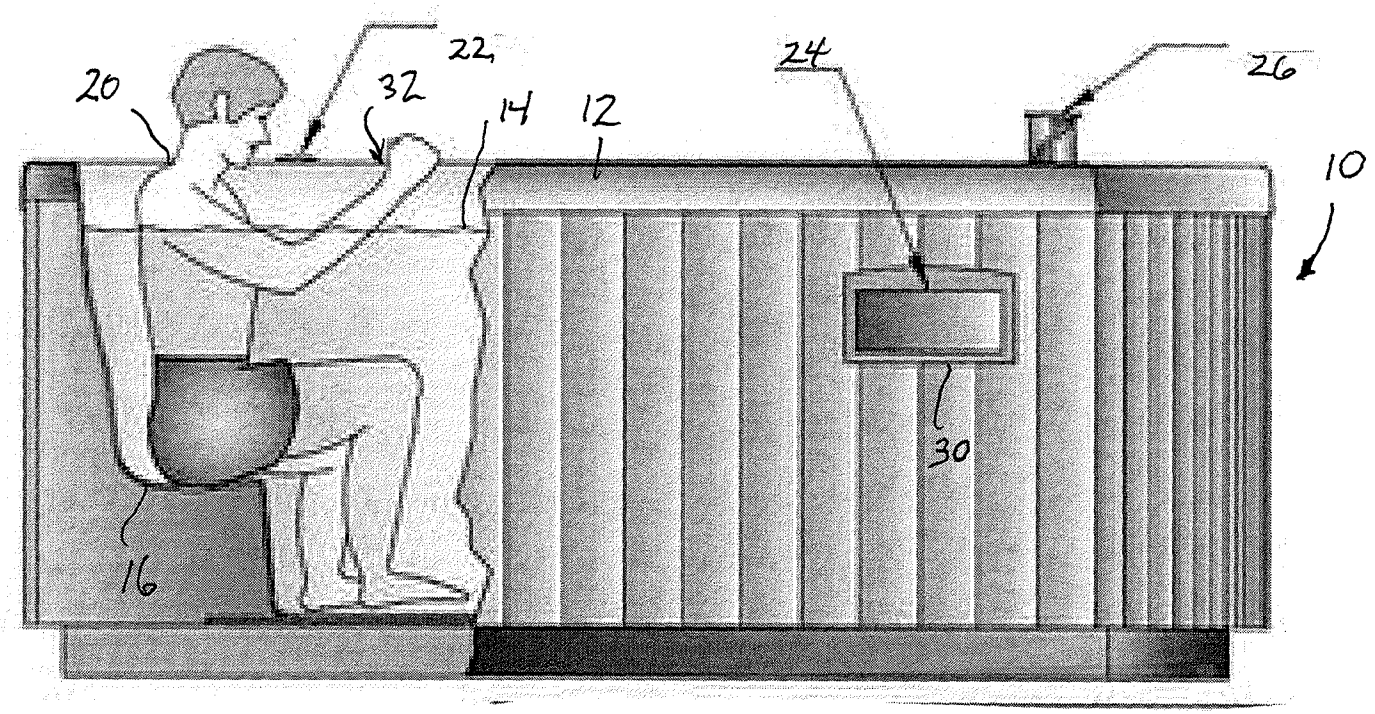
FIG. 1 is an elevation view, partly cut-away, of a spa according to the invention.
Figure 2:
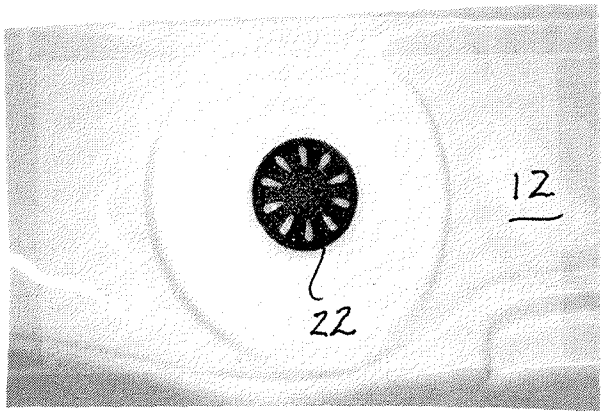
FIG. 2 is a detail plan view of a microphone mounted on a side wall of a spa according to the invention.

With reference to FIG. 1, a spa 10 has side walls 12 for containing a volume of heated, jetted water 14. Seats 16 are provided for accommodating one or more individuals 20 while immersed in water 14.

Many cellular telephones are enabled to use a short range wireless format such as Bluetooth™ to communicate with other devices. Bluetooth is a short range wireless connectivity standard, using short wavelength radio waves, in the ISM band from 2400 to 2480 MHZ, to communicate between two paired devices within a range of up to 50 meters. Bluetooth has the advantage of allowing many different platforms to communicate wirelessly due to the wide acceptance of the standard. The current invention preferably uses Bluetooth standard devices (or other suitable short range wireless communication format) to communicate between the user's cellphone/mobile phone and the spa's audio system. The components of handsfree Bluetooth mobile phone systems currently developed for use with automobile stereo systems can be used for the corresponding components of the present invention, as modified for the application to a spa environment as described herein.

Provided above the water line 14 on a side wall 12 of the spa 10, or a top edge of side wall 12, is a microphone enclosure 22. Microphone enclosure 22, in a watertight enclosure which allows sound penetration, is electrically connected, either wirelessly by Bluetooth or wired through the sidewall 12 to input its signal to a Bluetooth enabled audio system 24, components of which, apart from the microphone and speakers, are preferably installed in a watertight compartment 30 in side wall 12. Compartment 30 is readily accessible to allow a Bluetooth enabled mobile phone to be paired to the audio system. Speakers 26 in watertight enclosures are electrically connected, either wirelessly by Bluetooth or wired through the sidewall 12 to receive an output signal from the Bluetooth enabled audio system 24. Such speakers may be of a design such as shown in US 2004/0068787.

A user control interface 32 may be provided along a sidewall 12 above the water line 14 to allow the individual 20 to answer or initiate a mobile phone call, adjust volume and select stored telephone numbers from a screen display. Control interface 32 is connected to audio system 24 either by wires or wirelessly. Alternatively the system can be controlled by audio voice commands through microphone 22 which are pre-programmed in known ways.

To operate the system, the user places a Bluetooth-capable mobile phone near the spa within Bluetooth range. Power is provided to the Bluetooth-enabled audio system 24, and the mobile phone is paired to the audio system 24 using the indicators on the phone and audio system. Subsequently, when the phone is within range of the audio system, whether loose or in a watertight storage compartment such as compartment 30, when a telephone call is incoming on the mobile phone, an incoming call audio signal is communicated over speaker 26. The user can then answer the telephone call by pressing a button on the user interface 32 or by suitable voice commands. The user can then speak handsfree into microphone 22 to talk to the initiater of the telephone call, and will, handsfree, hear the voice of the other party to the call over speaker 26. The user can control the volume of the incoming audio using interface 32 or voice commands.

Individual 20 can place an outgoing telephone call, handsfree, by initiating suitable voice commands or selecting the telephone number on the interface 32 and pressing a call button. The user can then speak handsfree into microphone 22 to talk to the recipient of the telephone call, and will, handsfree, hear the voice of the other party to the call over speaker 26. The user can again control the volume of the incoming audio using interface 32 or voice commands.

Alternatively, the user can use an MP3-adapted smart phone or MP3 player to communicate via Bluetooth, music files to the Bluetooth enabled audio system for playing music files stored on the smart phone/player over speakers 26.

Figure 3:
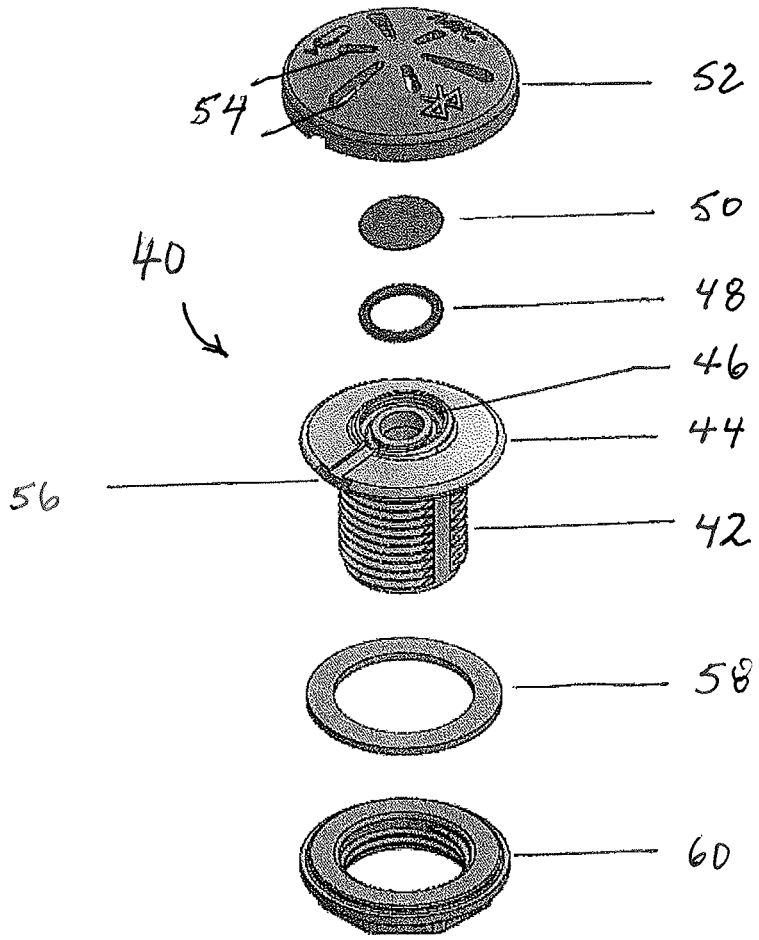
FIG. 3 is an exploded view of a surface mount microphone for use in the invention.

FIG. 3 is an exploded view of a slim line surface mount microphone housing 40 particularly suited for use in wet applications such as the invention. It provides an enclosure assembly that will hold a small standard microphone that will protect it from fluid penetration and moisture while minimizing impediment of voice sound transmissions, and so is suitable for use in the present spa application. It is surface mounted to provide minimal profile to be useful in the present invention.

According to the disclosed design, a suitable microphone (not shown) is placed into an externally threaded plastic housing 42 in the shape of a cylinder. This cylinder has a molded upper flange 44 that will allow the housing to mount flat against a flat walled surface such as the wall of the spa, with the cylindrical section of the housing 42 extending through a hole in the spa wall and the flange 44 sealing against the wall surface. This flange area also incorporates a recessed area around the microphone that is designed to support an O-ring rubber seal 48. On top of the O-ring 48 is placed a thin disc 50 made of a suitable plastic, such as polycarbonate and of suitable thickness to act as a diaphragm or drum to transmit sound waves. The final piece of the assembly is a molded domed shaped plastic cap or cover 52. Cap 52 has a series of radial slotted holes 54 in it that allow sound to pass through and reach the plastic disc 50. The disc 50 is held in place by a number of small posts molded on the underside of the cap 52 that hold it against the O-ring 48 when cap 52 snap fits onto flange 44. This then seals the microphone from fluids but allows voice vibrations to transfer through disc 50 to the microphone.

A drain trough 56 is molded into the housing flange 44 to assist in fluid drainage. A polymer flat seal ring 58 is used between the flange 44 and the mounting surface of the spa to seal out fluids. Finally a molded plastic threaded clamping nut 60 is used to secure the housing assembly 40 to the flat surface on a hot tub, spa or other exposed piece of equipment by screw threading onto housing 40 to tighten against the wall of the spa.

While a number of exemplary aspects and embodiments have been discussed above, those of skill in the art will recognize certain modifications, permutations, additions and sub-combinations thereof. It is therefore intended that the invention be interpreted to include all such modifications, permutations, additions and sub-combinations as are within their true spirit and scope.

What is claimed is:

1. A spa comprising a central, generally horizontal lower surface connected to a generally vertically extending perimeter wall comprising an upper horizontal surface, the inner surface of said vertical wall forming with said lower horizontal surface an upwardly open water-retaining chamber which contains water during normal use up to an upper water line, said spa being enabled to permit a user to conduct hands-free outgoing mobile telephone calls or receive hands-free incoming mobile telephone calls while immersed in the spa, comprising a blue-tooth enabled audio system including a microphone contained in a watertight enclosure mounted in said interior surface or said upper horizontal surface of said vertical wall located above the normal water line of the spa and one or more speakers located on, in or in proximity to said spa, whereby the blue-tooth enabled audio system is adapted to be paired with and wirelessly communicate with a blue-tooth enabled mobile phone to thereby permit hands-free use of said mobile phone in the spa.

2. The spa of claim 1 comprising a user control interface located on said inner surface or said upper horizontal surface of said vertical wall located above the normal water line of the spa accessible to a user and adapted to communicate wirelessly or by wires to said audio system.

3. The spa of claim 1 wherein said watertight enclosure comprises a hollow enclosure sized to extend through an aperture in the wall of said spa for receiving the microphone and having a sealable flange secured around the circumference of a first end of said hollow enclosure for sealingly securing said hollow enclosure to said wall, with a passage extending through said first end sealingly covered by a sound-transmitting element.

4. The spa of claim 3 wherein said sound transmitting element comprises a solid plastic sound-transmitting disc sealingly and replaceably secured over the end of said passage.

5. The spa of claim 4 wherein said hollow enclosure is provided with a groove around the passage extending through said first end for receiving an O-ring, and said sound transmitting disc is secured over said O-ring.

6. The spa of claim 5 wherein a passage is provided in said flange for draining liquid from said groove.

7. The spa of claim 4 wherein said sound transmitting disc is secured over said O-ring by a sound-penetrable cover removably secured to said flange.

8. The spa of claim 1 comprising a compartment accessible on the exterior of said spa for containing components of said blue-tooth enabled audio system.

* * * * *